United States Patent [19]

Strom et al.

[11] 4,418,961

[45] Dec. 6, 1983

[54] METHOD FOR RESTORING CONTAMINANTS TO BASE LEVELS IN PREVIOUSLY LEACHED FORMATIONS

[75] Inventors: E. Thomas Strom, Dallas; Wilton F. Espenscheid, DeSoto, both of Tex.

[73] Assignee: Mobil Oil Corporation, New York, N.Y.

[21] Appl. No.: 382,747

[22] Filed: May 27, 1982

Related U.S. Application Data

[63] Continuation-in-part of Ser. No. 221,726, Dec. 31, 1980, abandoned.

[51] Int. Cl.[3] ..... E21B 43/28

[52] U.S. Cl. ..... 299/5; 299/4

[58] Field of Search ..... 299/4, 5; 166/275, 305 R; 423/15, 17, 20, 261

[56] References Cited

U.S. PATENT DOCUMENTS

| | | | |
|---|---|---|---|
| 3,091,291 | 5/1963 | Little et al. | 166/275 X |
| 3,309,141 | 3/1967 | Fitch et al. | 299/5 |
| 4,105,253 | 8/1978 | Showalter | 299/5 X |
| 4,134,618 | 1/1979 | Kossack | 299/5 |
| 4,155,982 | 5/1979 | Hunkin et al. | 299/5 X |
| 4,234,231 | 11/1980 | Yan | 299/4 |
| 4,291,920 | 9/1981 | Lingane et al. | 299/4 |

OTHER PUBLICATIONS

Yan, "Calcite Control in In-Situ Uranium Leaching Process", *Journal of Petroleum Technology,* Nov. 1980, pp. 2068–2073.

*Primary Examiner*—George A. Suchfield
*Attorney, Agent, or Firm*—Alexander J. McKillop; James F. Powers, Jr.; John K. AboKhair

[57] ABSTRACT

The present invention relates to a method for restoring to environmentally acceptable levels the soluble contaminants in a subterranean formation that has been subjected to oxidative leaching. The contaminants are defined as those ionic species that when subjected to calcium ions form precipitates which are insoluble in the formation fluids. In accordance with the present invention, soluble calcium values are introduced into the formation. The level of contaminants is monitored and when such reaches the desired level, the introduction of soluble calcium values is stopped. The introduction of calcium values may be achieved in several ways one of which is to inject into the formation an aqueous solution containing therein solubilized calcium values. Another method of introducing calcium values into a formation, is to inject into the formation an aqueous solution containing carbon dioxide to solubilize calcium values, such as calcium carbonates, found in the formation.

16 Claims, No Drawings

METHOD FOR RESTORING CONTAMINANTS TO BASE LEVELS IN PREVIOUSLY LEACHED FORMATIONS

CROSS REFERENCE TO RELATED APPLICATIONS

This application is a continuation-in-part of the copending application Ser. No. 221,726 filed Dec. 31, 1980, now abandoned which is hereby incorporated by reference in its entirety.

FIELD OF THE INVENTION

This invention relates to techniques for restoring subterranean formations which have been subjected to in-situ leaching of mineral values.

BACKGROUND OF THE INVENTION

In-situ solution mining of mineral values is a known alternative to surface recovery processes particularly when the later is not economically feasible. Conventionally, in in-situ solution mining processes, the leaching solution is brought into contact with the subterranean deposit through a suitable injection system. The leaching solution or lixiviant may be an alkaline or acidic medium which solubilizes the mineral values as it traverses the ore body. Often, the mineral values in an ore body are subjected to an oxidation step in order to convert them to a soluble form. For example, the tetravalent uranium must be oxidized to its soluble hexavalent form for leaching. The pregnant lixiviant is then withdrawn from the ore body through a suitable production system and treated to recover mineral values therefrom by suitable techniques such as solvent extraction, direct precipitation or by absorption and elution employing an ion exchange resin. All too often, however, and in fact in the majority of cases, the oxidation step will result in the release into the formation of other minerals values than the desired mineral value to be recovered. These other mineral values may not be present in sufficient quantities to justify surface recovery. However they may be present in large enough quantities wherein the formation fluids have to be treated to reduce the concentration of such mineral values or contaminants to environmentally acceptable levels.

For example, recovery of uranium values from subterranean formations involves in the usual methods the oxidation of insoluble tetravalent uranium into soluble uranyl complexes that may be drawn from the formation by leaching. The overall reaction in oxidative in-situ leaching may be described as follows:

$$UO_2(s)+[O]+3HCO_3^- \rightarrow UO_2(CO_3)_3^{-4}+H^++H_2O$$

The use of oxygen, however, also solubilizes insoluble molybdate, among other minerals, into the toxic soluble molybdenite ion:

$$MoS_2+9[O]+3H_2O \rightarrow MoO_4^{=}+6H^++2SO_4^{=}$$

Current environmental regulations restrict the amount of molybdenum and sulfate permissable in formations after leaching to less than 1 ppm and 600 ppm respectively in New Mexico, for example.

Accordingly, this present invention provides a process for reducing the contaminants level in the formation fluids after the formation has been subjected to oxidative in-situ leaching to recover mineral values therefrom.

SUMMARY OF THE INVENTION

The present invention relates to a method for restoring the environmentally acceptable levels the soluble contaminants in a subterranean formation that has been subjected to oxidative leaching which comprises contacting the contaminants with calcium ions, wherein the contaminants are those ionic species that when subjected to calcium ions form a precipitate which is insoluble in the formation fluids. In one embodiment the invention comprises passing through said formation at least one pore volume of an aqueous restoration fluid that contains carbon dioxide. The restoration fluid may contain from 1 to 100 psig of carbon dioxide. This procedure is especially useful in mineral bearing formations which contain calcium carbonate minerals. The restoration fluid may be deoxygenated to a low level, i.e. an oxygen concentration in the order of 1 ppm or less, by such well recognized techniques as purging with argon. Where the oxidative leaching has been carried out in mineral bearing formations which contain little or no calcium carbonate minerals associated with a uranium, an alternate procedure may be used, which comprises introducing soluble calcium values into the formation, for example, by injecting aqueous calcium chloride into the formation. In carrying out either procedure, the array of injection and production wells already in place to carry out the oxidative leaching process may be used.

The method of this invention has the advantages of simplicity and effectiveness in restoring contaminants concentrations to acceptable environmental background levels. The invention thus reduces the environmental hazards to humans and animals which high levels of contaminants in the formation fluids may pose. Further advantages and features of this invention will be apparent to persons skilled in the art upon reading the specification and the claims appended hereto.

DESCRIPTION OF THE SPECIFIC EMBODIMENTS

While the present invention is hereinafter described in relation to restoration after in-situ recovery of uranium, it should be understood that the invention is also applicable to restoration efforts after the in-situ recovery of inoganic substances capable of reacting with aqueous solubilizers to form solutions miscible with water. These inorganic substances especially include phosphates, iron, aluminum, titanium, copper, nickel, silver, gold, lead, zinc, manganese, cobalt, chromium and molybdenum. Other substances soluble in aqueous solubilizers will be apparent to those skilled in the art.

The present invention may be carried out utilizing injection and production systems as the defined by any suitable arrangement of wells. The injection and production wells can be arranged in any convenient pattern designed to achieve maximum contact of the uranium containing zones by the leaching fluids, such as the conventional "five spot" pattern wherein a central well is surrounded by four somewhat symmetrically located injection wells. Another of the conventional flooding patterns that can be employed in the practice of this invention is the "line drive" pattern in which the injection wells are arranged in a line so that the injected fluids advance through the formation toward one or more spaced production wells that can also be arranged in a line substantially parallel to the line of injection wells. Other suitable patterns include staggered line drive, four spot, seven spot, circular flood patterns and others.

Uranium minerals frequently occur as a mixture of the insoluble tetravalent form and the soluble hexavalent form. The tetravalent form must be oxidized to its soluble hexavalent form for leaching. The oxidation of uranium to its soluble form also results in the oxidation of other mineral values that are present in the formation such as arsenic, boron, chromium, fluoride, selenium, molybdenum and sulfur. These other mineral species may not be present in sufficient quantities to justify surface recovery. However they are normally present in large enough quantities to require treatment of the formation fluids to reduce the concentration of these other minerals to environmentally acceptable levels.

The restoration of formations that have been subjected to in-situ leaching is a practice commonly required for environmental reasons. It has been found in connection with this invention that the passage through the formation of a restoration fluid which contains carbon dioxide will be bring calcium into solution in the formation via the dissolution of the calcium carbonate minerals which are associated with many uranium deposits:

$$H_2O + CO_2 \longleftrightarrow H_2CO_3$$

$$CaCO_3(insol) + H_2CO_3 \rightarrow Ca(HCO_3)_2(sol.) \rightarrow Ca^{++} + 2HCO_3^{=}$$

The calcium ions thus present in aqueous solution in the formation will form a precipitate with the soluble ions of the contaminants in the formation to form insoluble calcium precipitates. For example, calcium reacts with molybdate to form the insoluble calcium molybdate in accordance to the following equation:

$$Ca^{++} + MoO_4^{=} \rightarrow CaMoO_4(insoluble)$$

With increasing calcium ion values, the concentration of the contaminant mineral ion will be further depressed. For an insoluble precipitate such as calcium molybdate, the product of calcium ion concentration and molybdate ion concentration in the formation fluids must always be a constant, the solubility product. Accordingly, when the calcium ion concentration is increased in the formation, the contaminant mineral ion concentration must correspondingly decrease. The following Table I shows the solubility products of calcium compounds of restricted species in formation fluids after in-situ leaching operations.

TABLE I

SOLUBILITY PRODUCTS OF CALCIUM COMPOUNDS OF RESTRICTED SPECIES

| Species | Calcium Solubility Product | Environmental Standard ppm |
|---|---|---|
| Arsenic | $Ca(AsO_4)_2$, $6.8 \times 10^{-9}$ | 0.1 |
| Boron | $CaB_2O_4.4H_2O$, $6.25 \times 10^{-4}$ | 0.75 |
| | $CaB_2O_4.6H_2O$, $4.0 \times 10^{31\ 4}$ | |
| Chromium | $CaCrO_4$, $7.10 \times 10^{-4}$ | 0.05 |
| Fluoride | $CaF_2$, $2.7 \times 10^{-11}$ | 1.6 |
| Molybdenum | $CaMoO_4$, $4.2 \times 10^{-8}$ | 0.05 |
| Selenium | $CaSeO_3$, $8.0 \times 10^{-6}$ | 0.05 |
| | $CaSeO_4$, $8.1 \times 10^{-4}$ | |
| Sulfur | $CaSO_4$, $9.1 \times 10^{-6}$ | 600 |

In the formations that do not contain calcium carbonate minerals associated with the uranium therein, it is necessary to provide soluble calcium values to the formation. This may be achieved by injecting an aqueous solution of calcium chloride or calcium hydroxide. This step is also indicated when the use of restoration fluid containing carbon dioxide does not reduce soluble contaminant ions to environmentally acceptable levels at the rate observed for usual calcium carbonate containing formations. It is, of course, rare for a formation to be totally lacking in calcium carbonate values in association with uranium values.

The carbon dioxide level required in the restoration solution will depend on the amount of contaminants present in the formation after leaching and/or the minerology of the formation. By passing such a restoration fluid through formations after leaching, contaminant values may be reduced to environmentally acceptable levels. For example, molybdenum values may be reduced to less than one part per million, after the passage of one or more pore volumes through the formation. The determination of the attainment of environmentally acceptable levels of contaminants may be performed by any analytical procedure, such as atomic absorption spectroscopy, emission spectroscopy and the like.

The operability of this invention has been demonstrated by passing restoration fluid (Dallas tap water), deoxygenated with argon and containing 15 psig carbon dioxide, through a core from a uranium field from which the uranium has been previously partially leached. For example, Tables 2 and 3 show the effect of restoration in accordance with the present invention on the levels of molybdenum and selenium respectively. The molybdenum had been at 1 ppm or above through pore volumes of previous flushing with restoration fluid. The molybdenum and calcium concentrations were measured, and the results are shown in Table 2. The molybdenum concentration was reduced from 1.2 to 0.05 ppm after injection of just 2.8 pore volumes of a restoration solution containing 15 psig carbon dioxide.

From Table 3 it can be shown that after 80 pore volumes of restoration fluid, the selenium concentration, stayed above the environmentally accepted level of 0.05 ppm. After utilizing deoxygenated restoration fluid containing 15 psig carbon dioxide, the selenium level was reduced to 0.013 ppm after the injection of only two pore volumes.

TABLE 2

Effect of 15 psig $CO_2$ on Molybdenum and Calcium Levels

| Sample No. | Pore Volume | Molybdenum (ppm) | Calcium (ppm) |
|---|---|---|---|
| 127 | 1.227 | 0.990 | 24.25 |
| 128 | 1.623 | 0.960 | 23.75 |
| 129 | 1.187 | 1.11 | 23.75 |
| 130* | 0.837 | 1.21 | 23.25 |
| 131 | 1.108 | 0.876 | 69.25 |
| 132 | 1.681 | 0.052 | 295.50 |
| 133 | 0.667 | 0.047 | 300.50 |
| 134 | 1.185 | 0.022 | 269.00 |
| 135 | 1.264 | 0.024 | 259.00 |
| 136 | .419 | 0.005 | 257.00 |

*15 psig $CO_2$ added to deoxygenated fluid after Sample 130 was collected.

TABLE 3

Effect of 15 psig $CO_2$ on Selenium and Calcium Levels

| Sample No. | Pore Volume Restoration Fluid* | Selenium ppm | Calcium ppm |
|---|---|---|---|
| 123 | 79.56 | 0.066 | — |
| 124 | 1.23 | 0.068 | 6.6 |
| 126** | 1.98 | 0.013 | 13.5 |
| 127 | 1.38 | 0.018 | 16.9 |

TABLE 3-continued

Effect of 15 psig $CO_2$ on Selenium and Calcium Levels

| Sample No. | Pore Volume Restoration Fluid* | Selenium ppm | Calcium ppm |
|---|---|---|---|
| 128 | 1.44 | 0.017 | 17.0 |
| 136 | 9.36 | 0.020 | — |
| 138 | 1.23 | 0.016 | — |
| 140 | 1.93 | 0.021 | — |
| 142*** | 2.75 | 0.008 | — |

*Deoxygenated Dallas tap water
**Contains 15 psig $CO_2$
***Back to deoxygenated tap water This invention has the additional advantage of temporarily increasing uranium concentration in the restoration fluid because the additional bicarbonate provided by the solubilizing of calcium by the carbon dioxide in the restoration fluid will favor the formation of uranyl carbonate complex from the residual oxidized uranium in the formation:

$$UO_2^{++} + 3HCO_3^- \rightarrow UO_2(CO_3)_3^{-4} + 3H^+$$

The additional uranium obtained from the practice of this invention may be isolated by ion exchange or solvent extraction procedures to help defray part of the expense of restoration.

The foregoing description of the invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is our intention in the following claims to cover all such equivalent modifications and variations as fall within the true scope and spirit of our invention.

What is claimed is:

1. A method for restoring to environmentally acceptable levels the soluble contaminants in a subterranean formation that has been subjected to oxidative leaching which comprises:

(a) introducing into the formation soluble calcium values;

(b) monitoring the level of contaminants in the formation fluids; and (c) stopping the introduction of soluble calcium values after the concentration of the contaminants in the formation fluids reaches environmentally acceptable levels;

wherein the contaminants are ionic species that when subjected to calcium ions form precipitates which are insoluble in the formation fluids.

2. The method of claim 1 wherein the contaminants are one or more of ionic species selected from the group consisting of those containing arsenic, boron, chromium, fluoride, selenium, molybdenum, and sulfur.

3. The method of claim 1 wherein the contaminant is molybdate.

4. The method of claim 1 as applied after the in-situ oxidative leaching of uranium.

5. The method of claim 1 wherein the soluble calcium values are provided by the injection of an aqueous solution containing calcium chloride, calcium hydroxide, or combinations thereof.

6. The method of claim 5 wherein the aqueous solution containing calcium values is deoxygenated.

7. The method of claim 6 wherein the deoxygenation is accomplished by purging with argon.

8. A method for restoring to environmentally acceptable levels the soluble contaminantas in a subterranean formation that has been subjected to oxidative leaching which comprises:

(a) injecting into the formation an aqueous solution containing carbon dioxide;

(b) monitoring the level of the contaminants in the formation fluids; and (c) stopping the injection of the aqueous solution of carbon dioxide after the concentration of the contaminants in the formation fluids reaches environmentally acceptable levels;

wherein the contaminants are those ionic species that when subjected to calcium ions form precipitates which are insoluble in the formation fluids.

9. The method of claim 8 wherein the contaminants are one or more of ionic species selected from the group consisting of those containing arsenic, boron, chromium, fluoride, selenium, molybdenum, and sulfur.

10. The method of claim 8 wherein the contaminant is molybdate.

11. The method of claim 8 as applied after the in-situ oxidative leaching of uranium.

12. The method of claim 11 wherein the aqueous solution contains from 1 to 100 psig carbon dioxide.

13. The method of claim 12 wherein the restoration aqueous solution is deoxygenated.

14. The method of claim 13 wherein said restoration aqueous solution is deoxygenated by purging with argon.

15. A method for restoring to environmentally acceptable levels the soluble molybdenum values in a subterranean formation that has been subject to in situ oxidative leaching wherein said oxidative leaching is carried out in uranium-bearing formations containing little or no calcium carbonate minerals associated with said uranium, which process comprises:

introducing soluble calcium values into said leached formation.

16. The method of claim 15, wherein the soluble calcium values are provided by the injection of aqueous calcium chloride into the formation.

* * * * *